US005491382A

United States Patent [19]

Shimokobe et al.

[11] Patent Number: 5,491,382

[45] Date of Patent: Feb. 13, 1996

[54] COLOR PICTURE TUBE APPARATUS

[75] Inventors: Jiro Shimokobe; Eiji Kamohara; Takashi Nishimura, all of Fukaya, Japan

[73] Assignee: Kabushiki Kaisha Toshiba, Kawasaki, Japan

[21] Appl. No.: 303,814

[22] Filed: Sep. 9, 1994

[30] Foreign Application Priority Data

Sep. 9, 1993 [JP] Japan ..... 5-224076

[51] Int. Cl.[6] ..... H01J 29/70

[52] U.S. Cl. ..... 315/17; 348/810

[58] Field of Search ..... 315/17; 313/413, 313/426, 432, 434; 348/810

[56] References Cited

U.S. PATENT DOCUMENTS 2,927,236 3/1960 Andriulis .
3,417,199 12/1968 Yoshida et al. .
3,558,968 1/1971 Takayanagi .

FOREIGN PATENT DOCUMENTS 0198494 10/1986 European Pat. Off. .
2097489 3/1972 France .
61-263030 11/1986 Japan .
63-218130 9/1988 Japan .

*Primary Examiner*—Theodore M. Blum
*Attorney, Agent, or Firm*—Cushman Darby & Cushman

[57] ABSTRACT

In a color picture tube apparatus having a first auxiliary deflecting means for deflecting a single electron beam, emitted from a cathode, in a direction to separate from the tube axis in synchronism with switching among a plurality of video signals supplied to an electron gun, and splitting the single electron beam substantially into a plurality of beam segments, and a second auxiliary deflecting means, disposed between the first auxiliary deflecting means and a main deflecting unit, for deflecting the plurality of beam segments in a direction to come close to the tube axis, the first auxiliary deflecting means is constituted by an electrostatic deflecting lens provided to an accelerating electrode system between a control electrode and a focusing electrode of the electron gun, and the second auxiliary deflecting means is constituted by a main electron lens of the electron gun for finally focusing the electron beam segments on a phosphor screen. Accordingly, the entire length of the picture tube can be shortened, and the auxiliary deflecting power can be reduced as well as the manufacturing cost.

7 Claims, 3 Drawing Sheets

COLOR PICTURE TUBE APPARATUS

BACKGROUND OF THE INVENTION

1. Field of the Invention

The present invention relates to a color picture tube apparatus and, more particularly, to a color picture tube apparatus for displaying an image by time-dividing a single electron beam substantially into a plurality of beams.

2. Description of the Related Art

Generally, a color picture tube apparatus incorporates an electron gun assembly for emitting three electron beams. The three electron beams emitted from the electron gun assembly are deflected by a magnetic field generated by a deflecting unit. The deflected beams scan a phosphor screen opposing the electron gun assembly through a shadow mask in the horizontal and vertical directions, thereby displaying a color image on the screen.

In contrast to this color picture tube apparatus, Jpn. Pat. Appln. KOKAI Publication No. 61-263030 discloses a color picture tube apparatus in which a single electron beam is emitted from a cathode and time-divided substantially into three electron beams, thereby displaying an image.

More specifically, as shown in FIG. 1, this color picture tube apparatus has an electron gun comprising one cathode K for emitting a single electron beam 1, first, second, third, fourth, and fifth grids (only a fourth grid G4 is shown in FIG. 1) which are arranged between the cathode K and a phosphor screen 2 and control, accelerate, and focus the electron beam or electron beam segment(s) emitted from the cathode K, and a convergence electrode C. In this apparatus, the fourth grid G4 is constituted by two electrodes opposing each other as the first auxiliary deflecting means. The single electron beam 1 from the cathode K is electrostatically deflected by the first auxiliary deflecting means in three steps in a direction to separate from a tube axis Z, so that it is split into three beam segments. The convergence electrode C is constituted by a pair of central electrodes C1 serving as the second auxiliary deflecting means and a pair of two side electrodes C2 arranged on the two sides of the central electrodes C1. Each electron beam segment deflected by the first auxiliary deflecting means in the direction to separate from the tube axis is electrostatically deflected by the convergence electrode C in a direction to come close to the tube axis Z.

Referring to FIG. 1, reference numeral 5 denotes a main deflecting unit for deflecting the three beam segments; 6, a deflection center plane of the main deflecting unit 5; 7, a shadow mask; and 8, a three-color video signal switch for switching among red, green, and blue video signals.

According to this color picture tube apparatus, since the gap among the electron beam segments that are incident on the deflection center plane of the deflecting unit can be made small, a high-resolution, high-convergence color image can be displayed.

This color picture tube apparatus, however, has problems as follows. Namely, two auxiliary deflecting means are required for auxiliary deflection of the single electron beam emitted from the cathode. This increases the entire length of the picture tube and the deflecting power required for auxiliary deflection. Also, the manufacturing cost increases.

As described above, a color picture tube apparatus which time-divides a single electron beam substantially into three electron beam segments is conventionally known. However, since this color picture tube apparatus requires two auxiliary deflecting means for auxiliary deflection of the single electron beam, the entire length of the picture tube increases, and the deflecting power required for auxiliary deflection also increases. Again, the manufacturing cost rises.

SUMMARY OF THE INVENTION

It is an object of the present invention to provide a color picture tube apparatus for dividing a single electron beam substantially into three electron beam segments by two auxiliary deflecting means, in which the entire length of the picture tube, the deflecting power required for auxiliary deflection, and the manufacturing cost can all be reduced.

According to the present invention, there is provided a color picture tube apparatus comprising an electron gun, which has a cathode for generating an electron beam and a plurality of electrodes, that are arranged sequentially in a direction from the cathode toward a phosphor screen and control, accelerate, and focus the electron beam emitted from the cathode, and which emits a focused electron beam toward the phosphor screen; a main deflecting unit for deflecting the electron beam emitted from the electron gun, thereby scanning the phosphor screen in horizontal and vertical directions; first auxiliary deflecting means for deflecting a single electron beam, emitted from the cathode, in a direction to separate from a tube axis in synchronism with switching among a plurality of video signals supplied to the electron gun, thereby splitting the single electron beam substantially into a plurality of beams; and second auxiliary deflecting means, disposed between the first auxiliary deflecting means and the main deflecting unit, for deflecting the plurality of beams in a direction to come close to the tube axis, wherein the first auxiliary deflecting means is constituted by an electrostatic deflecting lens provided to an accelerating electrode system portion between the control and focusing electrodes of the electron gun, and the second auxiliary deflecting means is constituted by a main electron lens, of the electron gun, for finally focusing the electron beams on the phosphor screen.

As described above, when the first and second auxiliary deflecting means are provided and the main electron lens is utilized as the second auxiliary deflecting means, a second auxiliary deflecting means need not be particularly provided, and the entire length of the picture tube, the auxiliary deflecting power, and the manufacturing cost can all be reduced.

When the first auxiliary deflecting means is constituted by the electrostatic deflecting lens provided between the control and focusing electrodes, since auxiliary deflection is performed in a region where the electron beam has a low speed, the auxiliary deflecting power can be decreased. Also, since first auxiliary deflection is performed near the crossover point of the electron beam, even if the second auxiliary deflecting means is constituted by the main electron lens, a plurality of split beams can be focused and converged simultaneously.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

The preferred embodiment of a color picture tube apparatus according to an embodiment of the present invention will be described with reference to the accompanying drawings.

Figure 3:
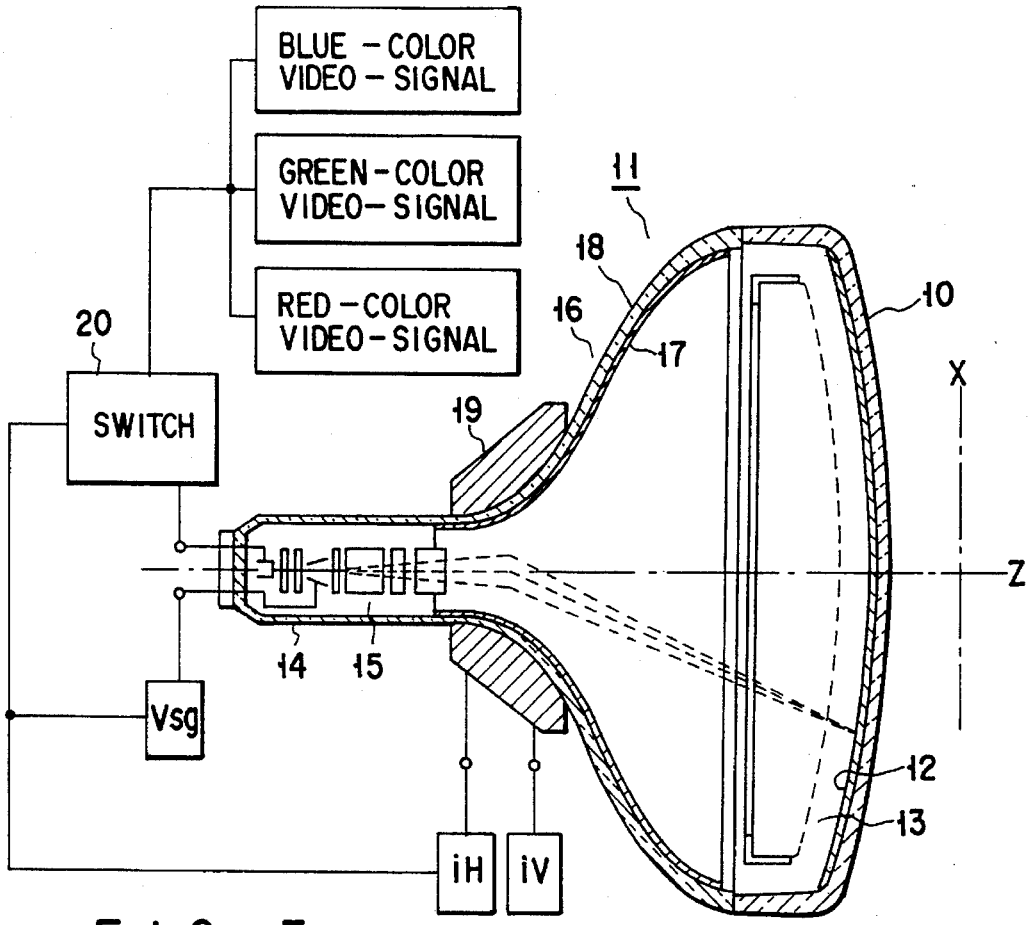
FIG. 3 is a sectional view schematically showing the structure of a color picture tube apparatus according to the embodiment of the present invention.

FIG. 3 shows the structure of the color picture tube apparatus according to the embodiment of the present invention. This color picture tube apparatus has an envelope constituted by a panel 10 and a funnel 11 integrally bonded to the panel 10. A phosphor screen 12 comprising three-color stripe phosphor layers that emit blue, green, and red light is formed on the inner surface of the panel 10. A shadow mask 13 formed with a large number of electron beam passage openings is arranged inside the phosphor screen 12 to oppose it. An electron gun 15 is sealed in a neck 14 of the funnel 11. In the funnel 11, an inner surface conductive film 17 is formed to extend from the inner surface of a large-diameter portion 16 to an inner surface adjacent to the neck 14 of the funnel 11. This inner surface conductive film 17 is connected to an anode terminal 18 provided on the side surface of the large-diameter portion 16 of the funnel 11. A main deflecting unit 19 is adhered on the outer side of the boundary between the large-diameter portion 16 and the neck 14 of the funnel 11.

Figure 2:
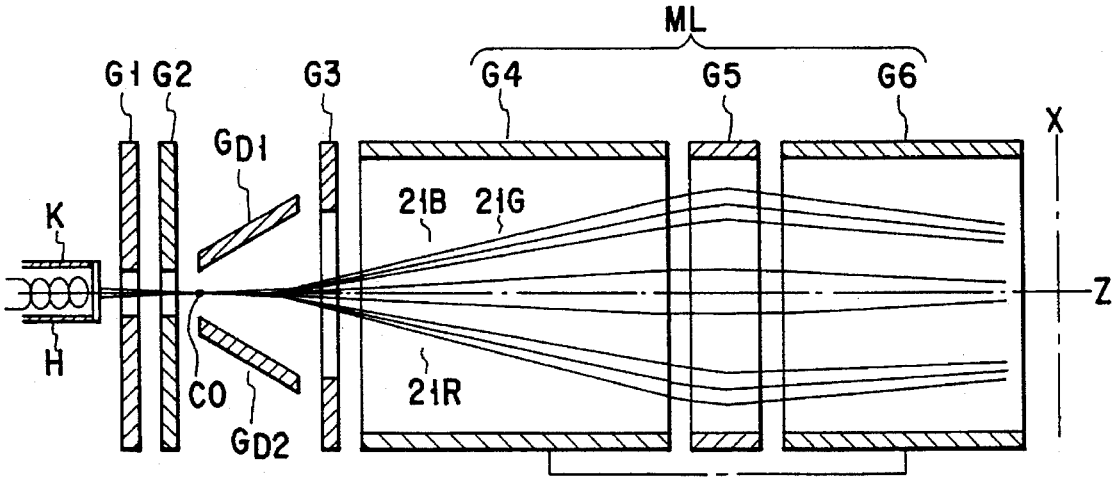
FIG. 2 is a sectional view schematically showing the structure of an electron gun according to an embodiment of the present invention.

As shown in FIG. 2, the electron gun 15 has a cathode K for emitting a single electron beam, a heater H for heating the cathode K, and first to sixth grids G1 to G6 for controlling, accelerating, and focusing the electron beam or electron beam segments from the cathode K. The cathode K, the heater H, and the first to sixth grids G1 to G6 are integrally fixed with a pair of insulating supports (not shown).

The first and second grids G1 and G2 are constituted by flat electrodes closely opposing each other. Comparatively small circular openings are formed in the plate surfaces of the grids G1 and G2, respectively, and pass the electron beam therethrough. The third grid G3 is also constituted by a flat electrode. A circular opening larger than that of the second grid G2 is formed in the third grid G3 to pass the electron beam segments therethrough. The fourth, fifth, and sixth grids G4, G5, and G6 are constituted by cylindrical electrodes through which the electron beam segments pass and which are arranged at predetermined gaps therebetween.

In this color picture tube apparatus, an auxiliary deflecting means comprising a pair of deflecting electrodes GD1 and GD2, i.e., the first auxiliary deflecting means, is arranged in an accelerating electrode system between the second and third grids G2 and G3. The pair of deflecting electrodes GD1 and GD2 are arranged to oppose each other in the horizontal direction, e.g., in the X-axis direction through a tube axis z coinciding with the axis of the electron gun, such that the gap between the deflecting electrodes GD1 and G3 is larger at the third grid GD3 side than at the second grid G2 side. The deflecting electrodes GD1 and GD2 are fixed to a pair of insulating supports together with the respective electrodes of the electron gun.

Voltages as defined below are applied to the respective electrodes of the electron gun. More specifically, the cathode K is kept at a cut-off electrode of about 150 V. Three color video signals are sequentially supplied to the cathode K through a three-color video signal switch 20 at a predetermined period. The first grid G1 is applied with the ground potential. The second and third grids G2 and G3 are applied with a voltage of about 700 V. The fourth grid G4 is applied with a voltage of about 15 kV. The fifth grid G5 is applied with the ground potential. The sixth grid G6 is applied with a voltage of about 15 kV, which is the same as the voltage applied to the fourth grid G4. The first auxiliary deflecting means is applied with a voltage of about 700 V so that a potential difference of about several tens to several hundreds V is set between the pair of deflecting electrodes GD1 and GD2.

As a result of this voltage application, generation of the single electron beam from the cathode K is controlled by the first and second grids G1 and G2. The emitted electron beam forms a crossover CO in the vicinity of the second grid G2, and is incident on an electrostatic deflecting lens formed by the pair of deflecting electrodes GD1 and GD2 of the first auxiliary deflecting means, so that it is split into three electron beam segments. Thereafter, the three electron beam segments pass through the third grid G3, and are incident on a main electron lens ML formed by the fourth, fifth, and sixth grids G4, G5, and G6, so that they are finally focused on the phosphor screen.

In this case, when the voltage applied to the pair of deflecting electrodes GD1 and GD2 of the first auxiliary deflecting means is changed in three steps in synchronism with the three color video signals supplied to the cathode K, the first auxiliary deflecting means deflects the single electron beam, which is incident thereon through the crossover CO, in three steps in the horizontal direction to separate from the tube axis, thereby splitting the single electron beam substantially into three electron beam segments 21B, 21G, and 21R that are modulated by the three color video signals. Of the three electron beam segments 21B, 21G, and 21R, the center electron beam segment 21G which is not deflected is incident on the central portion of the main electron lens ML formed by the fourth, fifth, and sixth grids G4, G5, and G6, and reaches the central portion of the phosphor screen through the central portion of the main electron lens ML. The side electron beam segments 21B and 21R, which are deflected by the first auxiliary deflecting means, are incident on the peripheral portion of the main electron lens ML, and are deflected by the lens operation of the main electron lens ML in the horizontal direction such that the central axes of the electron beam segments 21B and 21R come close to the tube axis Z.

More specifically, in this electron gun, the main electron lens ML formed by the fourth, fifth, and sixth grids G4, G5, and G6 has a function of finally focusing the electron beam segments on the central portion of the phosphor screen, and a function as the second auxiliary deflecting means of converging the three electron beam segments 21B, 21G, and 21R, obtained by three-step deflection of the first auxiliary deflecting means on the phosphor screen. The three electron beam segments 21B, 21G, and 21R, which are deflected by the first auxiliary deflecting means in a direction to separate from the tube axis, are finally focused and converged on the central portion of the phosphor screen by the operations of the main electron lens ML.

The third grid G3 prevents a quadrupole lens, that distorts an electron beam, from being formed between the pair of deflecting electrodes GD1 and GD2 of the first auxiliary deflecting means and the high-potential fourth grid G4.

Figure 4:
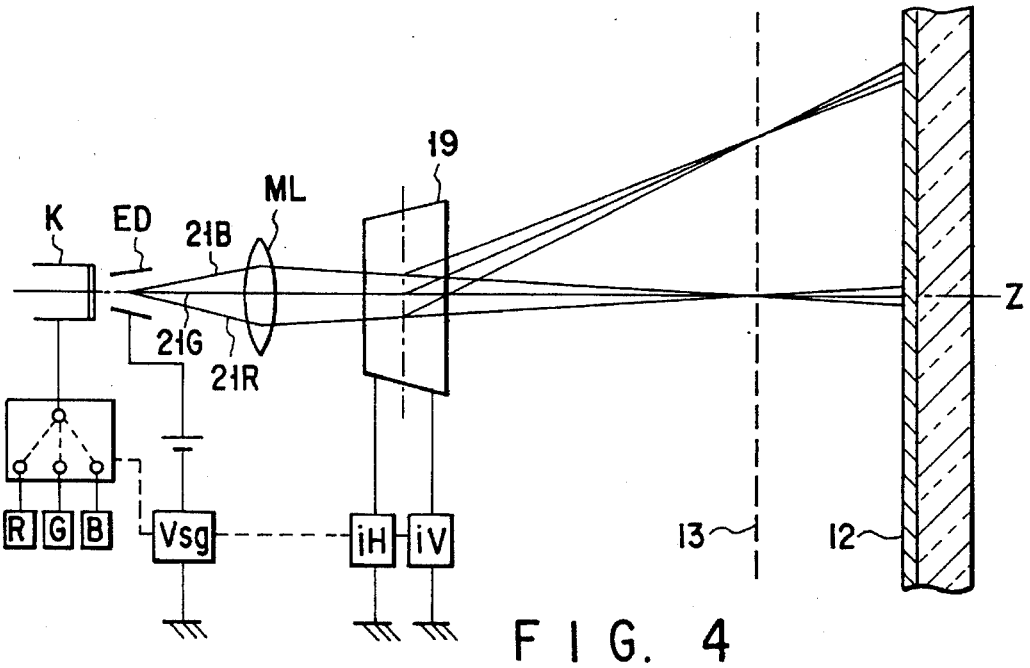
FIG. 4 is a diagram for explaining the operation of this color picture tube apparatus.

Therefore, when the first auxiliary deflecting means is provided to the electron gun in the manner as described above, as shown in FIG. 4, the single electron beam emitted from the cathode K is deflected by an electrostatic deflecting lens ED, formed by the first auxiliary deflecting means, in the horizontal direction to separate from the tube axis Z, and is split substantially into three electron beam segments 21B, 21G, and 21R modulated by the three color video signals. The three electron beam segments 21B, 21G, and 21R are focused and deflected by the main electron lens ML in the horizontal direction to be close to the tube axis Z. Thereafter, the three electron beam segments 21B, 21G, and 21R are deflected by a magnetic field generated by the main deflecting unit 19. The phosphor screen 12 is scanned in the horizontal and vertical directions by the three deflected electron beam segments through the shadow mask 13.

Figure 1:
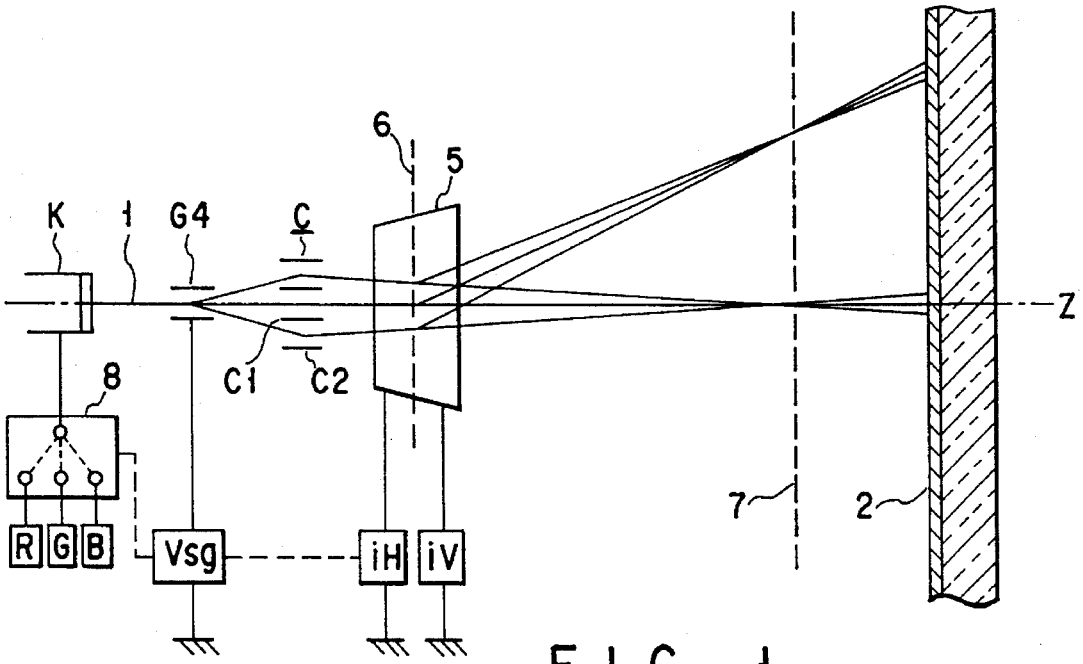
FIG. 1 is a diagram for explaining the operation of a conventional color picture tube apparatus.

In the electron gun having the above structure, a second auxiliary deflecting means is not particularly needed in addition to the first auxiliary deflecting means, the second auxiliary deflecting means typically deflecting the three electron beam segments 21B, 21G and 21R, that are deflected by the first auxiliary deflecting means in the direction away from the tube axis, back in a direction toward the tube axis. Thus a space for providing the second auxiliary deflecting means is not necessary. Accordingly, the entire length of the color picture tube apparatus can be shortened. When compared to the apparatus shown in FIG. 1 which has a particular second auxiliary deflecting means, in the apparatus shown in FIG. 4, an increase in deflecting power can be avoided, and the manufacturing cost of the color picture tube apparatus can be decreased.

Figure 5A:
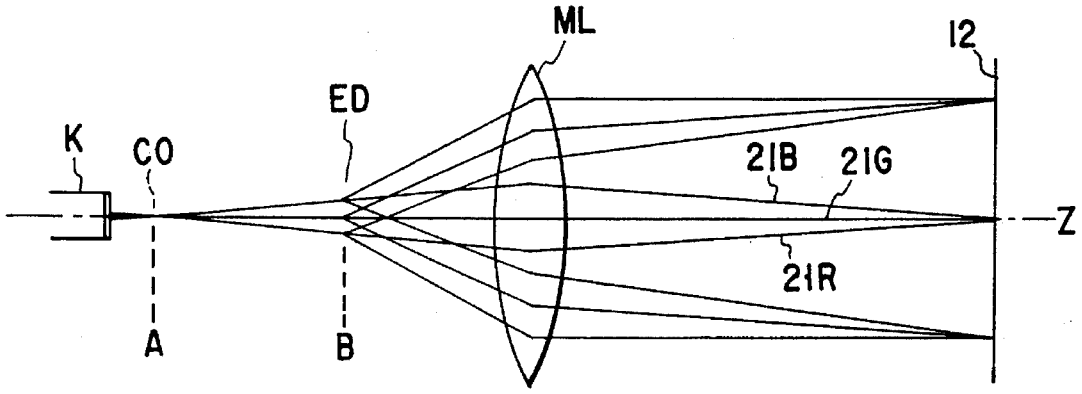
FIGS. 5A and 5B are diagrams for explaining focusing and convergence of three electron beam segments by the electron lens of the color picture tube apparatus.

When the lens operation of the main electron lens ML of the electron gun is utilized as the second auxiliary deflecting means, as described above, focus and convergence of the three electron beam segments 21B, 21G, and 21R are sometimes difficult to perform simultaneously in an optimum state. More specifically, in FIG. 5A, after the single electron beam emitted from the cathode K forms a crossover CO, it is deflected by the electrostatic deflecting lens ED, formed by the first auxiliary deflecting means, in a direction away from the tube axis Z. This causes it to split substantially into the three electron beam segments 21B, 21G, and 21R. The three electron beam segments 21B, 21G, and 21R are then focused and converged by the main electron lens ML. In this structure, an object point A seen from the main electron lens ML and related to focusing of the respective electron beam segments 21B, 21G, and 21R coincides with the position of the crossover CO. Meanwhile, an object point B related to convergence coincides with the position of the electrostatic deflecting lens ED formed by the first auxiliary deflecting means. As the object point related to focusing and the object point related to convergence do not coincide, focusing and convergence cannot be performed simultaneously. For example, if the main electron lens ML has a power appropriate for convergence of the three electron beam segments 21B, 21G, and 21R, the three electron beam segments 21B, 21G, and 21R are over-focused. On the other hand, if the main electron lens ML has a power appropriate for focusing of the three electron beam segments 21B, 21G, and 21R, the three electron beam segments 21B, 21G, and 21R are insufficiently converged.

Figure 5B:
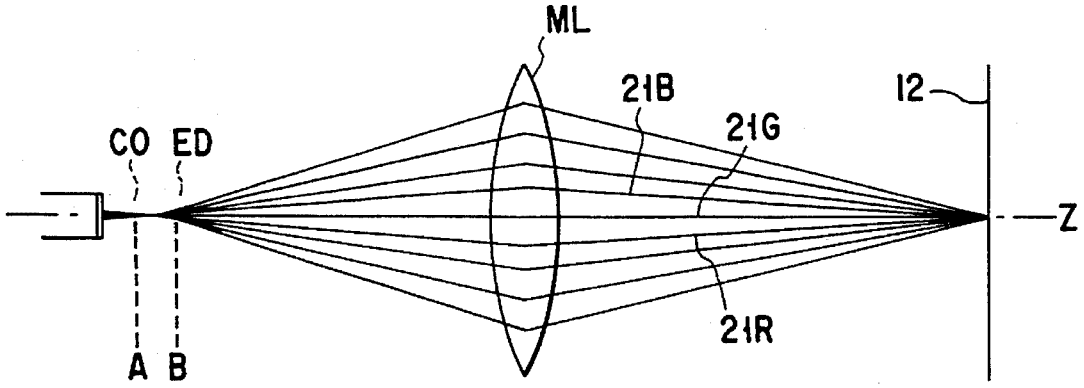

However, as in this color picture tube apparatus, assume that the first auxiliary deflecting means is provided in the vicinity of the second grid G2 serving as the accelerating electrode. For instance, the first auxiliary deflecting means is arranged between the first grid G1 serving as the control electrode and the fourth grid G4 serving as the focusing electrode. Then, as shown in FIG. 5B, the object point A seen from the main electron lens ML and related to focusing of the three electron beam segments 21B, 21G, and 21R, i.e., the position of the crossover CO, and the object point B related to convergence, i.e., the position of the electrostatic deflecting lens ED formed by the first auxiliary deflecting means, are sufficiently close to each other. Thus, focusing and convergence of the three electron beam segments 21B, 21G, and 21R can be simultaneously performed in an optimum state.

In this case, even if the object point A related to focusing and the object point B related to convergence do not strictly coincide with each other, since the error of the uncoincidence is sufficiently small, it can be adjusted by a beam track adjusting magnet which is conventionally used in an ordinary color picture tube apparatus.

Concerning convergence of the three electron beam segments 21B, 21G, and 21R, Jpn. Pat. Appln. KOKAI Publication No. 61-265989 discloses a technique in which the electron gun is fabricated as an electron gun that emits three electron beams parallel to each other and the convergence error on the phosphor screen is corrected by controlling the phases of the three color video signals. When the present invention is combined with this technique, a color picture tube apparatus having the same effect can be obtained. In this case, the three electron beams need not be converged completely on the phosphor screen. It suffices if at least after the three electron beam segments are converged by the main electron lens ML, they are deflected parallel to each other or in a direction to be close to the axis of the electron gun.

As described above, when the first auxiliary deflecting means for deflecting the electron beam emitted from the cathode K, in three steps in a direction to separate from the tube axis, and splitting the single electron beam substantially into three electron beam segments, is arranged in the accelerating electrode system arranged between the control and focusing electrodes of the electron gun 15, even if the main electron lens ML of the electron gun 15 is used as the second auxiliary deflecting means for deflecting the three electron beam segments, deflected in the direction to separate from the tube axis, in a direction to come close to the tube axis, focusing and convergence of the three electron beam segments can be simultaneously performed in an optimum state. In addition, since the accelerating electrode system portion is maintained at a comparatively low potential of about 1 kV at maximum, power required for auxiliary deflection of the electron beam can be decreased.

In the above embodiment, an electron gun in which the main electron lens constitutes a uni-potential type electron lens has been described. The present invention can also be applied of other electron guns.

In the above embodiment, the three electron beam segments obtained by the first and second auxiliary deflecting means are arranged in a line. However, the present invention can also be applied to a case wherein the three electron beam segments obtained by these auxiliary deflecting means are arranged in a delta shape.

In the above embodiment, an electron beam is deflected by the first auxiliary deflecting means in three steps to substantially obtain three electron beam segments. Deflection performed by the first auxiliary deflecting means is not limited to deflection in three steps. The present invention can also be applied to a case wherein an electron beam is deflected in a plurality of steps to obtain substantially a plurality of beams.

In the above embodiments, a color picture tube apparatus having one electron gun for one phosphor screen has been described. The present invention can also be applied to each electron gun of a color picture tube apparatus as disclosed in Jpn. UM Appln. KOKAI Publication No. 47-9349, Jpn. UM Appln. KOKOKU Publication No. 39-25641, Jpn. Pat. Appln. KOKOKU Publication No. 42-9349, and the like, wherein one phosphor screen is scanned with electron beams emitted from a plurality of electron guns by being divided into a plurality of regions.

In a color picture tube apparatus having a first auxiliary deflecting means for deflecting a single electron beam, emitted from a cathode, in a direction to separate from the tube axis in synchronism with switching among a plurality of video signals supplied to an electron gun, and splitting the single electron beam substantially into a plurality of beam segments, and a second auxiliary deflecting means, disposed between the first auxiliary deflecting means and a main deflecting unit, for deflecting the plurality of beam segments in a direction to come close to the tube axis, when the first auxiliary deflecting means is constituted by an electrostatic deflecting lens provided to the accelerating electrode system between the control and focusing electrodes of the electron gun, and the second auxiliary deflecting means is constituted by a main electron lens of the electron gun for finally focusing the electron beam segments on a phosphor screen, a second auxiliary deflecting means is not particularly required. Therefore, the entire length of the picture tube, the auxiliary deflecting power, and the manufacturing cost can all be decreased. Since the first auxiliary deflecting means performs auxiliary deflection at a region where the electron beam has a low speed as the electrostatic deflecting lens provided to the accelerating electrode system portion between the control and focusing electrodes, the auxiliary deflecting power can be reduced. Since first auxiliary deflection is performed near the crossover point of the electron beam, even if the second auxiliary deflecting means is constituted by the main electron lens, a plurality of beam segments can be simultaneously focused and converged.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A color picture tube apparatus comprising:

means for generating first, second, and third video signals;

means for generating a single electron beam;

applying means for continuously and alternately supplying said first, second, and third video signals to said single electron beam generating means to modulate said single electron beam;

control means for forming a crossover by controlling said single electron beam;

auxiliary deflecting means for accelerating said single electron beam from said crossover, said auxiliary deflecting means splitting said accelerated single electron beam into first, second, and third electron beam segments respectively corresponding to said first, second, and third video signals, said auxiliary deflecting means splitting said accelerated single electron beams by performing electrostatic auxiliary deflection of said accelerated single electrode beam in synchronism with application of said first, second and third video signals to said single electron beam generating means;

light ray generating means for generating light rays in response to incidence of said first, second, and third electron beam segments;

an electron lens for focusing said first, second, and third electron beam segments from said first auxiliary deflecting means on said light ray generating means; and main deflecting means for deflecting said first, second, and third electron beam segments to scan said light ray generating means with said electron beam segments in horizontal and vertical directions, wherein said auxiliary deflection means are located sufficiently close to said crossover to permit said auxiliary deflecting means to focus said first, second and third electron beam segments directly upon said electron lens.

2. An apparatus according to claim 1, wherein said control means includes first, second, and third flat grid electrodes each having an opening through which said single electron beam passes.

3. An apparatus according to claim 2, wherein said first auxiliary deflecting means includes a pair of deflecting electrodes arranged between said second and third grid electrodes, said pair of deflecting electrodes being arranged such that a gap therebetween widens along a traveling direction of said electron beam.

4. An apparatus according to claim 1, wherein said electron lens includes fourth, fifth, and sixth cylindrical grid electrodes through which said first, second, and third electron beam segments pass.

5. The color picture tube apparatus of claim 1, wherein the first, second and third electron beam segments are focused upon said electron lens in a single deflection.

6. A color picture tube apparatus comprising:

means for generating first, second, and third video signals;

means for generating a single electron beam;

applying means for continuously and alternately supplying said first, second, and third video signals to said single electron beam generating means to modulate said single electron beam;

control means for forming a crossover by controlling said single electron beam;

a single auxiliary deflecting unit for accelerating said single electron beam from said crossover, said auxiliary deflecting unit splitting said accelerated single electron beam into first, second, and third electron beam segments respectively corresponding to said first, second, and third video signals, said auxiliary deflecting unit splitting said accelerated single electron beams by performing electrostatic auxiliary deflection of said accelerated single electrode beam in synchronism with application of said first, second and third video signals to said single electron beam generating means;

light ray generating means for generating light rays in response to incidence of said first, second, and third electron beam segments;

an electron lens for focusing said first, second, and third electron beam segments from said auxiliary deflecting unit on said light ray generating means; and main deflecting means for deflecting said first, second, and third electron beam segments to scan said light ray generating means with said electron beam segments in horizontal and vertical directions.

7. A color picture tube apparatus as recited by claim 6, wherein said electron beam segments are deflected once by said single auxiliary deflecting unit, said deflected electron beam segments being cast directly upon said electron lens from said auxiliary deflecting unit.

* * * * *